US011319959B2

(12) United States Patent
Castle

(10) Patent No.: US 11,319,959 B2
(45) Date of Patent: May 3, 2022

(54) DRINKING VESSEL

(71) Applicant: Janet Castle, Golden, CO (US)

(72) Inventor: Janet Castle, Golden, CO (US)

( * ) Notice: Subject to any disclaimer, the term of this patent is extended or adjusted under 35 U.S.C. 154(b) by 494 days.

(21) Appl. No.: 15/948,690

(22) Filed: Apr. 9, 2018

(65) Prior Publication Data

US 2018/0298909 A1 Oct. 18, 2018

Related U.S. Application Data

(60) Provisional application No. 62/485,749, filed on Apr. 14, 2017.

(51) Int. Cl.

| | |
|---|---|
| ***F25D 31/00*** | (2006.01) |
| ***F04D 29/00*** | (2006.01) |
| ***F04D 25/00*** | (2006.01) |
| ***F04D 19/00*** | (2006.01) |
| ***A47G 19/00*** | (2006.01) |
| ***F04D 25/08*** | (2006.01) |
| ***A47G 19/22*** | (2006.01) |
| ***F04D 17/16*** | (2006.01) |
| ***F04D 29/42*** | (2006.01) |

(Continued)

(52) U.S. Cl.

CPC ..... *F04D 25/084* (2013.01); *A47G 19/2205* (2013.01); *A47G 19/2227* (2013.01); *F04D 17/16* (2013.01); *F04D 25/0673* (2013.01); *F04D 29/4226* (2013.01); *F04D 29/582* (2013.01); *A47G 2200/166* (2013.01); *F04D 29/281* (2013.01)

(58) Field of Classification Search

CPC .... F25D 31/006; F25D 31/007; F25D 31/008; F25D 2331/808; F25D 2331/809; F25D 2331/81; F25D 2331/811; A47G 19/2205; A47G 19/2288; F04D 25/084; F04D 29/281

See application file for complete search history.

(56) References Cited

U.S. PATENT DOCUMENTS 4,581,898 A * 4/1986 Preis ..... F25B 21/02 62/3.62
4,866,945 A * 9/1989 Bender ..... B67D 1/06 62/3.61

(Continued)

FOREIGN PATENT DOCUMENTS

CN 204862418 U 12/2015

*Primary Examiner* — Jianying C Atkisson
*Assistant Examiner* — Erik Mendoza-Wilkenfel
(74) *Attorney, Agent, or Firm* — Kilpatrick Townsend & Stockton LLP

(57) ABSTRACT

A drinking vessel for delivering air to a user may include an outer shell and an inner shell. The outer shell may define at least an air inlet at a lower region of the outer shell and an air outlet at an upper region of the outer shell. The inner and outer shells may together at least partially define an air flow passage which may be in communication with the air inlet and the air outlet. The drinking vessel may include an air moving device. The air moving device may be configured to move air from the air inlet, through the air flow passage, to the air outlet. The drinking vessel may include a power source and an actuation device. The actuation device may be operably coupled with the air moving device and the power source for selectively activating the air moving device with the power source.

18 Claims, 8 Drawing Sheets

(51) Int. Cl.

| | |
|---|---|
| ***F04D 29/58*** | (2006.01) |
| ***F04D 25/06*** | (2006.01) |
| *F04D 29/28* | (2006.01) |

(56) References Cited

U.S. PATENT DOCUMENTS

| | | | | |
|---|---|---|---|---|
| 5,042,258 | A * | 8/1991 | Sundhar | A47G 19/2288 62/3.2 |
| 5,460,571 | A * | 10/1995 | Kato | F04D 29/703 361/695 |
| 5,857,350 | A * | 1/1999 | Johnson | F24F 5/0035 62/314 |
| 6,227,004 | B1 * | 5/2001 | Gerstein | A47G 19/2288 62/421 |
| 6,454,539 | B1 | 9/2002 | Santos | |
| 7,089,749 | B1 * | 8/2006 | Schafer | B60H 1/00264 62/3.2 |
| 8,454,322 | B2 | 6/2013 | Gammack et al. | |
| 10,570,920 | B2 * | 2/2020 | Lee | F04D 29/441 |
| 2002/0043070 | A1 * | 4/2002 | Bedard | B67D 3/0012 62/68 |
| 2005/0150235 | A1 * | 7/2005 | Scott | F25D 31/006 62/3.2 |
| 2014/0263020 | A1 * | 9/2014 | MacDonald | C02F 1/003 210/232 |

* cited by examiner

DRINKING VESSEL

CROSS-REFERENCE TO RELATED APPLICATIONS

This application claims priority to, and the benefit of, U.S. Provisional Patent Application No. 62/485,749, filed Apr. 14, 2017, the entire contents of which are hereby incorporated by reference, for all purposes, as if fully set forth herein.

BACKGROUND OF THE INVENTION

Numerous situations may arise where people may need to be cooled off or warmed up. Such situations may include menopause hot flash moments, abrupt changes in temperature, and so on. Portable fans and/or heaters may be useful in those situations.

However, it may be impractical to carry a portable fan and/or heater around at all times. Further, those situations may occur suddenly in a setting, such as at a business or professional meeting, where it may be inappropriate or unprofessional to carry around and/or use a portable fan and/or heater.

BRIEF SUMMARY OF THE INVENTION

In one embodiment, a drinking vessel having an air moving device for delivering air to a user is provided. The drinking vessel may include an outer shell. The outer shell may define at least an air inlet at a lower region of the outer shell. The outer shell may further define at least an air outlet at an upper region of the outer shell. The drinking vessel may further include an inner shell coupled with the outer shell. The inner shell and the outer shell may together at least partially define an air flow passage. The air flow passage may be in communication with the air inlet and the air outlet. The drinking vessel may also include an air moving device. The air moving device may be configured to move air from the air inlet, through the air flow passage, to the air outlet. The drinking vessel may further include a power source. The power source may be operably coupled with the air moving device. The drinking vessel may also include an actuation device. The actuation device may be operably coupled with the air moving device and the power source for selectively activating the air moving device with the power source.

In another embodiment, a drinking vessel having an air moving device for delivering air to a user is provided. The drinking vessel may include an outer shell. The outer shell may define at least an air inlet. The air inlet may be disposed at a lower region of the outer shell. The outer shell may further define at least an air outlet. The air outlet may be disposed at an upper region of the outer shell. The drinking vessel may further include an air moving device. The air moving device may be configured to move air from the air inlet to the air outlet.

In another embodiment, a device having an air moving device for delivering air to a user is provided. The device may include an outer shell and an inner shell. The outer shell may define at least an air inlet at a lower region of the device. The inner shell may be coupled with the outer shell. The inner shell and the outer shell may together at least partially define an air outlet at a lower region of the device. The inner shell and the outer shell may together at least partially further define an air flow passage. The air flow passage may be in communication with the air inlet and the air outlet. The device may further include an air moving device. The air moving device may be configured to move air from the air inlet to the air outlet.

BRIEF DESCRIPTION OF THE DRAWINGS

Embodiments of the present invention are described in conjunction with the appended figures.

Figure 1:
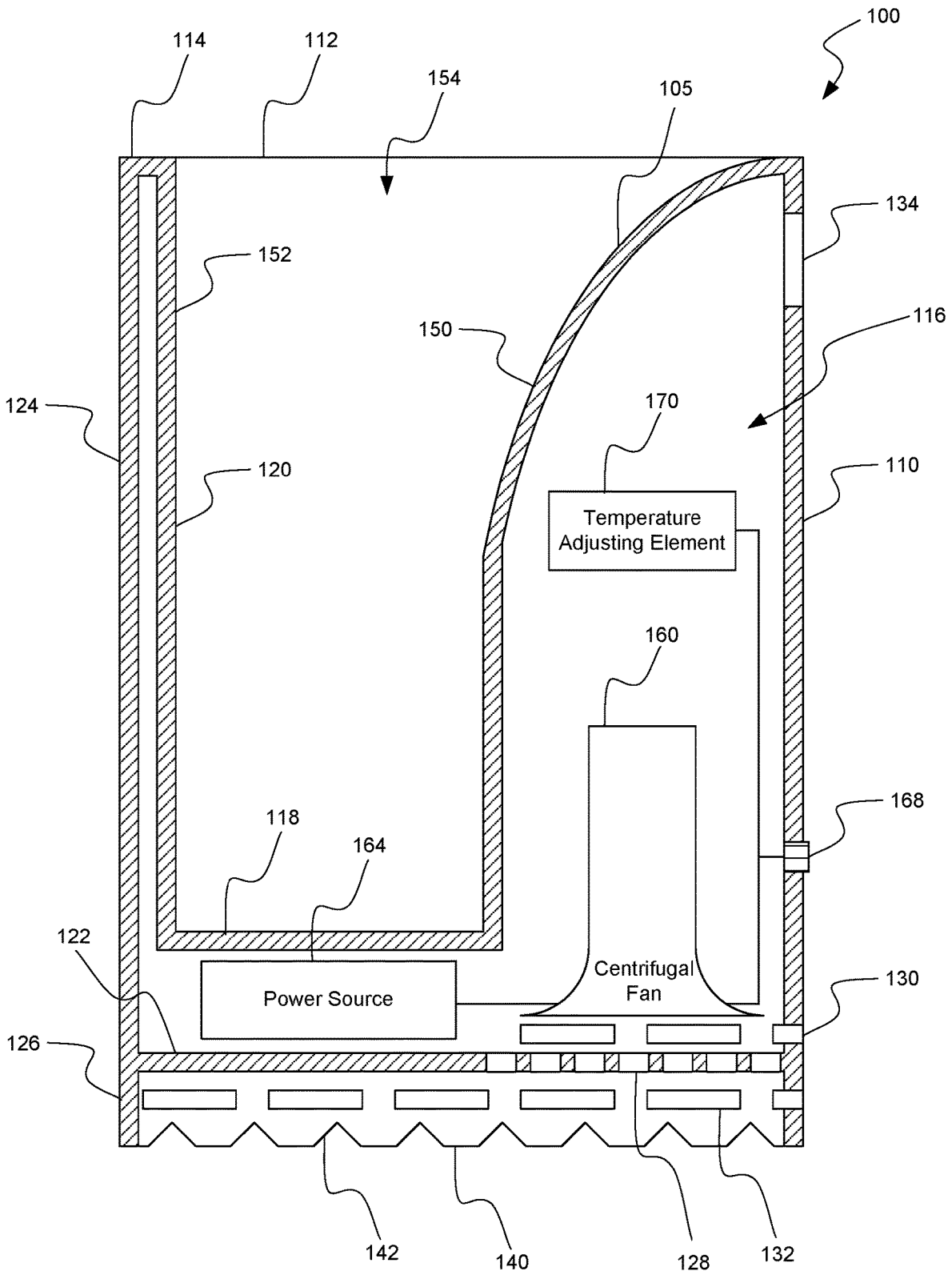
FIG. 1 illustrates an exemplary drinking vessel or drinking vessel-like device according to embodiments of the present disclosure.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

For example, any detail discussed with regard to one embodiment may or may not be present in all contemplated versions of that embodiment. Likewise, any detail discussed with regard to one embodiment may or may not be present in all contemplated versions of other embodiments discussed herein. Finally, the absence of discussion of any detail with regard to any embodiment herein shall be an implicit recognition that such detail may or may not be present in any version of any embodiment discussed herein.

According to the disclosure, a drinking vessel or drinking-vessel like device having an air moving device for delivering air to a user is provided. The drinking vessel may include an outer shell. The outer shell may define at least an air inlet at a lower region of the outer shell. The outer shell may further define at least an air outlet at an upper region of the outer shell. The drinking vessel may further include an inner shell coupled with the outer shell. The inner shell and the outer shell may together at least partially define an air flow passage. The air flow passage may be in communication with the air inlet and the air outlet. The drinking vessel may also include an air moving device. The air moving device may be configured to move air from the air inlet, through the air flow passage, to the air outlet. The drinking vessel may further include a power source. The power source may be operably coupled with the air moving device. The drinking vessel may also include an actuation device. The actuation device may be operably coupled with the air moving device and the power source for selectively activating the air moving device with the power source.

Nowadays, it may be very common for people to carry around a drinking vessel, such as a personal drinking vessel, and it may even be appropriate to carry around such personal drinking vessels in almost all settings, including business or professional settings. The drinking vessel or drinking vessel-like device as disclosed herein may function as a cooling or heating device to cool or warm up the user while at least appearing as any common drinking vessel for holding a liquid. This way, the user may enjoy the cooling or heating effect provided by the drinking vessel or the drinking vessel-like device on any occasion even when it may be inappropriate or unprofessional to use a cooling or heating fan. Additionally, the drinking vessel or drinking vessel-like device may also hold a liquid for the user's consumption. Throughout the description, drinking vessel and drinking vessel-like device may be used interchangeably when referring to the various embodiments that may be configured to deliver air to the user and/or to hold a liquid for the user's consumption.

In some embodiments, the drinking vessel may include an outer shell. The outer shell may define a shape that may resemble any common drinking vessel, such as glasses, cups, mugs, water bottles, thermoes, and so on. The outer shell may include a base or bottom and a side or side wall. The base may support the drinking vessel when the drinking vessel may be rested on a surface. The side may extend at least partially in an upward direction from an outer edge of the base. The side may include a top edge or top rim that may define an opening into the outer shell. In some embodiments, the side may extend in an upright direction from the base. In some embodiments, the side may be tapered and may extend from the base at an angle that may be greater than or less than 90 degrees. In some embodiments, the side may include curved wall portions that may extend from the base at varying angles. Thus, the opening defined by the top edge of the side may be less than, the same as, or greater than the size of the bottom. The side may be shaped like a cylinder, cone, barrel, frustum, or may be of any suitable shapes.

The outer shell may further include one or more support members extending at least partially in a downward direction from the base of the outer shell. The one or more support members may elevate the base of the outer shell from a surface upon which the drinking vessel may be rested.

In some embodiments, the one or more support members may include an annular protrusion that may be disposed around the outer edge of the base. The annular protrusion thus may form a continuous downward extension of the side of the outer shell. In some embodiments, the annular protrusion may extend downward from the base at an angle of about 90 degrees. In some embodiments, the annular protrusion may be tapered and may extend from the base at an angle that may be greater than or less than 90 degrees. The annular protrusion may include a bottom edge. In some embodiments, the bottom edge may include a linear profile such that the entire bottom edge may support the drinking vessel when it may be rested on a surface. In some embodiments, the bottom edge may include a non-linear profile. When the drinking vessel may be rested on a surface, one or more portions of the bottom edge may be elevated from the surface. The other portion or portions of the bottom edge may contact the surface and may support the drinking vessel on the surface. The elevated portion or portions of the bottom edge and the surface may define one or more openings that may allow air to move through. In some embodiments, the annular protrusion may be formed as a continuous loop. The continuous loop may include a bottom edge that may include a linear or non-linear profile as described above. In some embodiments, the annular protrusion may be formed as two or more segments or segmented protrusions that may collectively define a looped shape. The two or more segmented protrusions may define one or more spaces there-between that may allow air to move through. Each of the segmented protrusions may include a bottom edge that may include a linear or non-linear profile as described above.

In some embodiments, the one or more support members may further include one or more additional stabilizing units disposed on a bottom surface of the base inside the outer edge of the base to provide added support to, and/or to further stabilize, the drinking vessel when it may be placed on a surface. The one or more stabilizing units may include one or more ridges, ribs, feet, etc. disposed at the bottom surface of the base. The one or more stabilizing units may protrude from the bottom surface of the base at appropriate distances so that the protruding end of each of the stabilizing units may be level with the bottom edge of the annular protrusion or at least portions of the bottom edge of the annular protrusion that may support the drinking vessel on a surface. The one or more stabilizing units may be formed of any suitable materials, including relatively rigid materials, such as metal, hard plastic, etc. or relatively less rigid materials such as rubber, foam, etc. The one or more stabilizing units may be formed as an integral piece with the base or may be formed as separate pieces that may be attached to the bottom surface of the base. The stabilizing units may be disposed at any suitable locations at the bottom surface of the base, taking into consideration the weight distribution of the drinking vessel and other factors.

In some embodiments, the outer shell may define one or more air inlets and at least one air outlet. The outer shell may at least partially define an air flow passage. Each of the one or more air inlets and the at least one air outlet may be closeable at least partially by a closing mechanism, such as a sliding cover, shutters, cap, etc. The air flow passage may be in fluid communication with the one or more air inlets and the at least one air outlet such that air may be moved from the one or more air inlets to the at least one air outlet through the air flow passage. In some embodiments, the one or more air inlets may be disposed at a lower region of the outer shell, and the at least one air outlet may be disposed at an upper region of the outer shell. The one or more air inlets and/or the at least one air outlet may be disposed at any suitable regions of the outer shell, with one or more of the air inlets or the at least one air outlet disposed at the upper, the lower, or a middle region of the outer shell. In some embodiments, the inner shell may define one or more air inlets and/or the at least one air outlet as will be discussed in more detail below.

In some embodiments, the outer shell defining the one or more air inlets may include the base of the outer shell defining at least one of the one or more air inlets. In other words, the base of the outer shell may define one or more apertures that may constitute the at least one of the one or more air inlets. In some embodiments, the one or more apertures may be disposed at, adjacent, or near a center of the base. In some embodiments, the one or more apertures may be disposed between the center and the outer edge of the base. The one or more apertures may be circular, oval, polygonal, or of any suitable shape. In some embodiments, the one or more apertures may be one or more elongated slots, which may be arranged in parallel, concentrically, or radially.

The one or more apertures may be disposed in an area of the base above which an air moving device may be configured. Depending on the configuration and/or type of the air moving device utilized, the area may be circular, half-circular, oval, polygonal, or of any suitable shape. The one or more apertures may be loosely or closely arranged. Accordingly, the base may include a surface area, which may be defined as the entire area bounded by the annular protrusion minus the one or more apertures. The surface area of the base may constitute about 90% or less of the entire area bounded by the annular protrusion, and may constitute about 80% or less, or 70% or less, or 60% or less, or 50% or less, or 40% or less, or 30% or less, or 20% or less, or 10% or less of the entire area bounded by the annular protrusion in various embodiments. A higher surface area of the base may provide stronger structural support for various components that may rest upon the base. A smaller surface area of the base may facilitate air intake from the one or more apertures into the air flow passage. In some embodiments, the drinking vessel may further include a layer of mesh disposed adjacent or near the base.

In some embodiments, the outer shell defining the one or more air inlets may include the annular protrusion of the outer shell defining at least one of the one or more air inlets. In other words, the annular protrusion of the outer shell may define one or more apertures that may constitute the at least one of the one or more air inlets. In some embodiments, the one or more apertures may be arranged around the entire circumference of the annular protrusion. In some embodiments, the one or more apertures may be arranged along only a portion of the circumference of the annular protrusion. This way, the user of the drinking vessel may position or hold the drinking vessel in a manner such that the one or more apertures may face the user and thus may be visible to the user only but may not be visible to others. The one or more apertures defined by the annular protrusion may be in a circular, oval, polygonal, or any suitable shape, and may be arranged in a linear, non-linear, parallel, or any suitable manner. In some embodiments, the one or more apertures may be one or more elongated slots. The one or more elongated slots may be arranged along at least a portion of the circumference of the annular protrusion adjacent or near the base. When the drinking vessel may be rested on a surface, the one or more apertures defined by the annular protrusion may allow air to move through and to move toward the one or more air inlets defined by the base of the outer shell as discussed above.

Additionally, in some embodiments where the annular protrusion may include a bottom edge having a non-linear profile, when the drinking vessel may be rested on a surface, the one or more openings defined by the surface and portions of the bottom edge elevated from the surface may also allow air to move through and to move toward the one or more air inlets defined by the base. Further, in some embodiments where the annular protrusion may include two or more segmented protrusions, the spaces between the segmented protrusions may also allow air to move through and to move toward the one or more air inlets defined by the base.

In some embodiments, the outer shell defining the one or more air inlets may include the side of the outer shell defining at least one of the one or more air inlets. In other words, the side of the outer shell may define one or more apertures that may constitute the at least one of the one or more air inlets. The one or more apertures may be disposed adjacent or near the base. In some embodiments, the one or more apertures may be arranged at various locations along the entire circumference of the side adjacent or near the base. In some embodiments, the one or more apertures may be arranged at various locations along only a portion of the circumference of the side adjacent or near the base. For example, the one or more apertures may be arranged along only half or less of the circumference of the side adjacent or near the base. This way, the user of the drinking vessel may position or hold the drinking vessel in a manner such that the one or more apertures defined by the side adjacent or near the base may face the user and thus may be visible to the user only but may not be visible to others. The one or more apertures defined by the side may be in a circular, oval, polygonal, or any suitable shape, and may be arranged in a linear, non-linear, parallel, or any suitable manner. In some embodiments, the one or more apertures may be one or more elongated slots. The one or more elongated slots may be arranged along at least a portion of the circumference of the side adjacent or near the base.

In some embodiments, the outer shell defining the at least one air outlet may include the side of the outer shell defining the at least one air outlet. In other words, the side of the outer shell may define one aperture that may constitute the at least one air outlet. In some embodiments, the side may define more than one aperture that may be arranged closely and may collectively constitute the at least one air outlet defined by the outer shell. The one or more apertures may be in a circular, oval, polygonal, or any suitable shape, and may be arranged in a linear, non-linear, parallel, or any suitable manner. In some embodiments, the one or more apertures may be one or more elongated slots. The one or more apertures may be disposed closer to the top edge of the side than to the outer edge of the base. Specifically, the one or more apertures may be disposed at a first distance from the top edge of the side, and may be disposed at a second distance from the outer edge of the base. The first distance may be less than the second distance. With such disposition of the one or more apertures, when the user may desire to have cool or warm air delivered out of the one or more apertures to his or her neck and/or face, the user may raise the cup to a height as if the user may drink from the drinking vessel. Accordingly, although the user may use the drinking vessel as a heating or cooling device, the user may disguise his or her intention by appearing to raise the drinking vessel to drink from the drinking vessel.

The one or more apertures defined by the bottom, the side, and/or the annular protrusion that may constitute the one or more air inlets and/or the at least one air outlet may be closeable. The one or more apertures may be closed at least partially or entirely by a closing mechanism. In some embodiments, the closing mechanism may include an adjustable closing mechanism, such as one or more sliding covers or shutters. In some embodiments, the closing mechanism may include a cap or a plug that may be configured to cover or seal the one or more apertures. In some embodiments, the side may include one or more dividers forming a grid overlaying or underlying each of the one or more apertures. The grid may prevent the user's fingers from accidentally reaching in or other objects from getting into the air flow passage. The one or more dividers may be slanted so as to direct air flow into the air flow passage and towards the user. In some embodiments, the angle or orientation of the one or more dividers may be adjusted to direct the air to flow towards any suitable direction.

In some embodiments, the drinking vessel may further include a cover. The cover may be placed over the opening defined by the top edge of the side of the outer shell. The cover may define one or more apertures that may constitute the at least one air outlet. The one or more apertures may be in a circular, oval, polygonal, or any suitable shape, and may be arranged in a linear, non-linear, parallel, or any suitable manner. The one or more apertures defined by the cover may be one or more elongated slots. The one or more apertures may be closeable by a closing mechanism. The cover may include one or more dividers forming a grid overlaying or underlying each of the one or more apertures defined by the cover. The closing mechanism and the one or more dividers may be similar to those described above with reference to the one or more apertures defined by the side that may define the one or more air inlets and/or at least one air outlet. In some embodiments, the cover may further define a drinking portal that may be closeable. In some embodiments, the drinking portal may be configured to host a straw.

The cover may be coupled with the outer shell through mating threading. For example, the cover may include a downward extending annular lip. The annular lip may include threading formed on an internal surface of the annular lip. The outer shell may include threading formed adjacent or near its top edge on an exterior surface of the outer shell. The threading of the outer shell may mate with the threading of the cover so as to engage the cover to the outer shell. Alternatively, the annular lip may include threading formed on an exterior surface of the annular lip, and mating threading may be formed on an interior surface of the outer shell. In some embodiments, the coupling or engagement between the cover and the outer shell may include an interference or friction fit. In some embodiments, the cover and the outer shell may be formed as an integral piece. In these embodiments, an inner shell (as described below) may be omitted. In some embodiments, the cover may be coupled with the inner shell through threading, interference or friction fit, or any other suitable coupling mechanism.

In some embodiments, the drinking vessel may further include an inner shell coupled with the outer shell. The inner shell may be at least partially disposed inside the volume or space defined by the base and side of the outer shell. Similar to the outer shell, the inner shell may include a base or bottom, and a side or side wall that may extend at least partially in an upward direction from an outer edge of the base. The side may include a top edge or top rim that may define an opening into the inner shell. The inner shell and the outer shell may be coupled to each other along their respective top edges. The inner shell and the outer shell together may at least partially define the air flow passage. Unlike the outer shell, which may define one or more apertures at its base and/or side that may constitute the one or more air inlets or the at least one air outlet, the inner shell may be formed without any apertures at its base or side. Accordingly, the side and the base of the inner shell may define an inner compartment that may be separated from the air flow passage. When the user may place the cover onto the drinking vessel, the cover and the inner shell may together isolate the inner compartment from the air flow passage.

In some embodiments, the drinking vessel may include a removable container. The removable container may be disposed inside the inner compartment defined by the inner shell through the opening of the inner shell. The removable container may be configured to hold a liquid for consumption by the user. In some embodiments, the removable container may include a flange. The flange may contact the top edge of the inner shell when the removable container may be placed inside the inner compartment. Accordingly, the removable container may be supported at least by the top edge of the inner shell. In some embodiments, the removable container may include a tapered lip that may extend beyond the top edge of the inner shell, which may facilitate removal of the removable container from the inner compartment.

In some embodiments, the removable container may be only supported by the top edge of the inner shell and may not contact the side or the base of the inner shell. Thus, a gap may exist between the removable container and the inner shell. The gap may limit or prevent heat transfer between the removable container and the inner shell, which may limit or prevent any condensation that may be formed on the surface of the inner shell defining at least in part the air flow passage. As will be described in more detail below, one or more other units or components of the drinking vessel may be disposed in the air flow passage for the drinking vessel to function as a heating or cooling device. It may be desirable to limit condensation or moisture that may accumulate in the air passage.

In some embodiments, the removable container may further contact the side and/or the base of the inner shell. The side and/or the base of the inner shell may further support the removable container. In these embodiments, the removable container and/or the inner shell may be formed using insulating materials, may be formed using materials that may have low heat conductivity, such as plastic, ceramic, etc., so as to limit or prevent heat transfer between the removable container and the inner shell. Limiting or preventing such heat transfer may also facilitate maintaining the temperature of the liquid contained in the removable container at a desirable temperature by the user.

In some embodiments, heat transfer between the removable container and the inner shell may be desirable. For example, the removable container may be configured to hold one or more cooling or heating/warming components that may absorb or release heat so as to cool or warm the air flowing through the air flow passage defined at least in part by the inner shell. In these embodiments, the removable container, as well as the inner shell, may be formed of materials that may have relatively high heat conductivity, such as metal. The cooling components may include reusable cooling pads, cubes, or pouches, or simply ice cubes, cold liquid, etc. The heating/warming components may include reusable heating/warming pads, cubes, or pouches, or simply hot or warm liquid. In some embodiments, the inner shell may be configured to hold the cooling or heating/warming components without using the removable container.

In some embodiments, because the at least one air outlet may be disposed only at select locations at the side of the outer shell so as to be hidden from view of others, the air flow passage may be configured to guide the air flow from the one or more air inlets at, adjacent, or near the base of the outer shell towards the at least one air outlet adjacent or near the top or bottom edge of the outer shell and/or the inner shell, or between the inner and outer shells and/or the removable container. For example, the opening of the inner shell may include a size and/or shape similar to the size and/or shape of the outer shell so as to facilitate the coupling of the inner shell and the outer shell at their respective top edges. But the side of the inner shell may be sized and/or shaped different from the side of the outer shell for guiding the air flow toward the at least one air outlet. For example, the side of the outer shell may be shaped to resemble a common drinking vessel. Accordingly, the side of the outer shell may be symmetrical, and may define a cylinder. The side of the inner shell may not be symmetrical. At least a portion of the side of the inner shell may be tapered. For example, a portion of the side of the inner shell facing the at least one air outlet may be tapered inwardly such that at least the tapered portion and the side of the outer shell may define a funnel with the smaller end of the funnel disposed proximate the at least one air outlet. In some embodiments, the tapered portion may extend from near the top edge of the inner shell all the way toward the base of the inner shell. In some embodiments, the tapered portion may extend from the top edge of the inner shell only part way toward the base of the inner shell. The portion of the side of the inner shell opposite the at least one air outlet may not be tapered so as to maximize the inner compartment of the inner shell for holding the removable container and/or the liquid for consumption by the user. Accordingly, the base of the inner shell may include a size that may be less than the size of the base of the outer shell.

In the above embodiments, the inner shell may be disposed off-center inside the outer shell. In some embodiments, the inner shell may be placed at or near a center of the outer shell. The air flow passage may be defined by the space between the side of the inner shell and the side of the outer shell. In some embodiments, the air flow passage may be further defined at least by the space between the inner shell and the removable container. In some embodiments, the space may define an annular prism. In some embodiments, the inner shell, the outer shell, and/or the removable container may be configured to direct the air flow in a diverging or converging manner as will be discussed in more detail below. Because substantially the entire surface area of at least the side of the inner shell may be exposed to the air flow passage, and in some embodiments, substantially the entire surface area of the removable container may be exposed to the air flow passage, the temperature of the air flowing through the air flow passage may be more efficiently or easily adjusted by the heating or cooling elements, such as warm or cold liquid discussed above, which may be placed inside the inner shell and/or the removable container inside the inner shell.

In these embodiments, the drinking vessel may include an air outlet similar to the at least one air outlet discussed above, which may be formed at the side of the outer shell or the cover. In some embodiments, the air outlet of the drinking vessel may be defined as an annular gap between the top edge of the inner shell and the top edge of the outer shell. In some embodiments, the air outlet of the drinking vessel may be defined as an annular gap between the bottom edge of the inner shell and the bottom edge of the outer shell. By configuring the inner shell and the outer shell, the air flow passage and the air outlet may guide air to flow in a divergent manner. For example, the side of the outer shell may be tapered outwardly from the base of the outer shell. The side of the inner shell may also be tapered outwardly from the base of the inner shell. With such configuration, air flowing out of the air outlet may diverge such that air may be delivered to an area greater than an area defined by the air outlet or greater than an area defined by the top edge of the outer shell. Accordingly, the user may use the drinking vessel to cool or warm up a body area without moving the drinking vessel around or excessively. For example, when the user desires to cool his/her face, which may typically be of an area greater than the opening of a common drinking vessel. By diverging the air flow to a greater area, the user may simply raise the cup near his/her mouth and enjoy a flow of cool or warm air towards his/her entire face without moving the drinking vessel around.

In some embodiments, the air flow passage and the air outlet may be configured to guide air to flow in a convergent manner such that air may be delivered to an area less than an area defined by the air outlet or less than an area defined by the top edge of the inner shell. For example, the side of the outer shell may be tapered inwardly from the base of the outer shell. Optionally and additionally, the side of the inner shell may be tapered inwardly from the base of the outer shell. With such configuration, air flowing out of the air outlet may converge, which may effectuate a quicker relief for the user from the heat or cold the user may be experiencing.

Although various embodiments described herein may include the outer shell and the inner shell, some embodiments may only include the outer shell which may be shaped like a common drinking vessel. Whether utilizing only the outer shell or utilizing both the inner shell and the outer shell, the configuration of the outer shell and/or inner shells, as well as the disposition and configuration of the one or more air inlets or the at least one air outlet, may be based on an overall consideration of the air flow speed, air pressure increase and/or drop, or other air flow properties of the air delivered through the one or more air inlets, through the air flow passage, and/or through the at least one air outlet. For example, the base and/or the side of the inner shell and the base and/or the side of the outer shell may be configured to define the air flow passage to facilitate laminar flow and to minimize turbulent flow so as to reduce noise generated and/or vibration of the drinking vessel. Additionally, because in some of the embodiments, air may be funneled toward the at least one air outlet, there may be a sudden air pressure drop as the air may flow through the at least one air outlet. The size and/or the shape of the at least one air outlet may be configured in such a manner so as to reduce potential noise that the air flowing through the at least one air outlet may generate.

In the above embodiments, the at least one air outlet may be configured at or near an upper region of the drinking vessel or drinking vessel-like device. In some embodiments, the drinking vessel or drinking vessel-like device may include an inner shell and an outer shell that may each be configured with an open bottom, and the inner shell and the outer shell may define an air outlet at or near a lower or bottom region of the drinking vessel or drinking vessel-like device. The outer shell and the inner shell may be configured such that air exiting the air outlet near the bottom region of the drinking vessel may be flowed towards an upper region of the device through a space defined by the inner shell. For example, in some embodiments, the inner shell may include a top rim that may define a top opening and a bottom rim that may define a bottom opening which may have a substantially circular shape. The outer shell may include a top rim coupled with the top rim of the inner shell. The outer shell may further include an annular lip that may define a cylindrical opening. The cylindrical opening may be concentrically aligned with the bottom opening defined by the bottom rim of the inner shell. The annular lip may be positioned radially inward from the bottom rim of the inner shell and may extend upward into the bottom opening defined by the bottom rim of the inner shell such that the annular lip may overlap vertically with a lower portion of the inner shell. The overlapping portions of the annular lip and the inner shell may define an annular air outlet that may guide air to move upward towards the top opening defined by the top rim of the inner shell. As air may be moved toward the top opening of the inner shell, a lower pressure zone may be created inside the inner shell. The lower pressure zone may cause more air to be drawn from the cylindrical opening defined by the annular lip of the outer shell from the bottom of the outer shell.

In some embodiments, a removable container for holding a beverage or any liquid therein may be placed inside the compartment defined by the inner shell. To hold the removable container in place, the annular lip of the outer shell may be tapered outwardly upward for receiving a bottom portion of the removable container. The removable container may be supported by the annular lip in a manner such that a gap or space may be maintained between the removable container and the inner shell to allow air exiting the annular outlet defined by the overlapping portion of the annular lip and the lower portion of the inner shell to move towards the top opening of the inner shell.

As will be described in more detail below, various other components or units may be disposed inside the space defined by the outer shell and the inner shell. The disposition or placement of those components and units may also affect the air flow properties. Those components or units may be disposed in a manner so as to limit air turbulence they may cause.

In some embodiments, the drinking vessel or the drinking-vessel-like device may further include an air moving device for moving air from the one or more air inlets to the at least one air outlet. The air moving device may include a centrifugal fan. The centrifugal fan may be positioned inside the air flow passage and may be positioned between at least a non-tapered portion of the side of the inner shell and the side of the outer shell. In some embodiments, the air moving device may include an axial fan. The axial fan may be positioned inside the air flow passage and may be positioned between at least the base of the inner shell and the base of the outer shell. The centrifugal fan or the axial fan may be configured such that their respective air intake ports may be disposed near the one or more air inlets, and their respective air outflow ports may be oriented to flow air toward the at least one air outlet. The centrifugal fan or the axial fan may be further configured with one or more apertures to further facilitate air intake by the centrifugal fan or the axial fan. Such one or more apertures may be formed at a bottom and/or a side of the respective centrifugal fan or the axial fan. Although centrifugal and axial fans are described herein as examples, the air moving device may include bladeless fans that may be configured to move air from the one or more air inlets to the at least one air outlet through the air flow passage.

In some embodiments, the outer shell may further include a handle configured to house the air moving device. Specifically, the handle may define a housing in fluid communication with the air flow passage defined by the inner shell and the outer shell. The air moving device may be configured inside the housing. The housing may be configured near a lower region, a middle region, an upper region, or any other suitable region of the handle. The handle may further define one or more apertures, through which air may be drawn into the housing, then moved into the air flow passage, and then moved through the air outlet toward the user.

In some embodiments, instead of being configured inside a drinking vessel or drinking vessel-like device, the air moving device may be configured inside a detachable or removable air moving system that may be easily place onto and removed from any drinking vessel a user may desire to use. For example, the air moving system may be configured with an air moving mechanism similar to any of the drinking vessel-like devices described above, but may be configured with much smaller height dimensions as compared to the height dimensions of the drinking vessels or drinking vessel-like device. As such, the air moving system may resemble a ring member that may be placed around a lower portion, a middle portion, or an upper portion of any drinking vessel a user may desire.

In some embodiments, the drinking vessel or the drinking vessel-like device may further include a power source operably coupled with the air moving device. The power source may include a battery unit. In some embodiments, the battery unit may include one or more battery cells, such as rechargeable or non-rechargeable battery cells, including but not limited to, alkaline batteries, lithium ion batteries, etc. In some embodiments, the battery unit may include a casing having one or more battery cells enclosed therein. The casing and the enclosed battery cells may be removed from the drinking vessel, recharged, and replaced back to the drinking vessel. In some embodiments, the battery unit may be recharged while remaining inside the drinking vessel. In some embodiments, the battery unit may be of a kind that may allow for wireless charging. Thus, the drinking vessel may be placed on a charging pad while the battery unit may be charged. In some embodiments, the drinking vessel may include a charging port disposed on the side of the outer shell for charging the battery unit. The charging port may include USB charging ports, such as micro or macro USB ports, so that the battery unit may be easily charged from an electrical source, such as a computer, wall charger, etc.

The battery unit may be disposed inside the space defined by the outer shell and the inner shell. Such space may include the air flow passage as described above. The battery unit may be disposed adjacent to or near the air moving device so as to minimize electrical wiring. In some embodiments, the battery unit may be positioned below the base of the inner shell and above the base of the outer shell. The disposition of the battery unit and the disposition of the air moving device may be coordinated such that the center of mass of the drinking vessel may be centered along a vertical axis of the outer shell. In some embodiments, the outer shell may include a removable bottom cover for access to and removal of the battery unit. In some embodiments, the outer shell may not include a removable bottom cover to reduce number of pieces to be manufactured. As such, the battery unit may not be removed from the drinking vessel. The battery unit may be charged through the charging port or using a wireless charging pad as described above.

In some embodiments, the drinking vessel or drinking vessel-like device may also include an actuation device. The actuation device may be operably coupled with the air moving device and the power source for selectively activating the air moving device with the power source. In some embodiments, the actuation device may be disposed at the base of the outer shell so that it may be hidden from view. In some embodiments, the actuation device may be disposed on the side of the outer shell. The actuation device may be disposed at the middle or lower region of the side of the outer shell such that the actuation device may be touched and pressed by the user's hand or finger(s) when the user may pick up and/or hold the drinking vessel as if he/she would pick up and/or hold any common drinking vessel. In some embodiments, the drinking vessel may include a handle. The actuation device may be disposed at the handle or adjacent to or near the handle on the side of the outer shell. The actuation device may include a toggle switch or a push button switch. In some embodiments, the actuation device may be a touch switch or a swipe switch. By decorating the touch or swipe switch in accordance with the patterns that may be included on the side of the outer shell, the switch may be completely disguised.

In some embodiments, the drinking vessel or the drinking vessel-like device may further include a sensor unit. The additional sensor unit may include a motion sensor, a temperature sensor, a pressure sensor, etc. For example, the sensor unit may be configured to detect the movement of the drinking vessel, which may often happen when the user may desire warm or cool air to be delivered. The actuation device may be configured to activate the air moving device upon detection of such movement of the drinking vessel by the sensor unit. In some embodiments, the sensor unit may be configured to detect the ambient temperature. For example, if the sensor unit may detect that the ambient temperature may be above or below certain predetermined values, then the actuation device may be configured to activate the air moving device to deliver cool or warm air accordingly. Accordingly, the user may simply place the drinking vessel on a surface with the air outlet pointed in a general direction toward the user, and without raising the cup, the user may enjoy a flow of cool or warm air when the temperature around the user may get too high or too low. Depending on the particular sensor and the parameters the sensor intended to detect, the individual sensors may be disposed inside or outside the space between the inner shell and the outer shell. For example, the motion sensor may be positioned at any suitable location. The temperature sensor may be positioned at the base or at the exterior surface of the outer shell for detecting the ambient temperature. Other sensors and their respective appropriate disposition may be contemplated.

In some embodiments, the drinking vessel or the drinking vessel-like device may further include a temperature adjusting element for changing a temperature of air flowed through the air flow passage. The temperature adjusting element may be disposed in the space between the inner shell and the outer shell. The air moving device may be configured to move air passing by, across, or through the temperature adjusting element such that a temperature of air passing through the one or more air inlets may be different from a temperature of air passing through the at least one air outlet. The temperature adjusting element may be operably coupled with the power source. In some embodiments, the temperature adjusting element may include one or more heating coils that may generate joule heat when electricity may be supplied by the power source. In some embodiments, the temperature adjusting element may include one or more thermoelectric units that may be configured to cool or heat the air flowing through the air flow passage. As discussed above, the removable container or the inner shell may contain one or more cooling and/or heating/warming components placed therein. The temperature adjusting element and the cooling and/or heating/warming components may be utilized together to change the temperature of air flowing through the air flow passage.

The drinking vessel or drinking vessel-like device may further include a control unit, such as a processor or chip coupled with the air moving device, the activation device, the sensor unit, the temperature adjustment component, and so on to control or facilitate the operation of each component or unit. In some embodiments, the control unit may be configured to allow the user to adjust the speed of the air flow by adjusting the rotation speed of the centrifugal or axial fan discussed above, thereby allowing the user to minimize or maximize the airflow quickly and discreetly. The control unit may be further configured to allow the user to control and/or adjust the temperature of the air delivered to the user. For example, the control unit may allow the user to activate the cooling or the heating function of the temperature adjusting element. The control unit may be further configured to turn off the air moving device, the temperature adjusting element, or other units or components if the drinking vessel may be left idling beyond a predetermined period of time. The control unit may be configured to achieve any other desired functionalities.

In some embodiments, a detachable holder for any of the drinking vessels or drinking vessel-like devices described herein may be provided. The detachable holder may be configured to support the drinking vessel to which the holder may be attached and to provide better fitting into standard or common cup holders. The detachable holder may include a threaded top portion for engaging mating threading that may be formed at a bottom portion of the drinking vessel attached thereto. In some embodiments, the detachable holder may be fitted into a bottom opening of the drinking vessel and attached thereto through a latch device, or via interference fit, snap fit, or any suitable engagement mechanism. In some embodiments, the detachable holder may further include a battery unit and may be configured with ports for charging or providing power for the drinking vessel attached thereto.

The outer shell, the inner shell, the removable container, the cover, and other components of the drinking vessel may be formed of the same or different materials. The materials for forming one or more of the components may be BPA free. One or more of the inner shell, the outer shell, the removable container, or the cover may be formed of metal, alloy, plastic, rubber, ceramic, glass, etc. The inner shell, the outer shell, and/or the removable container may be formed of relatively rigid material so as to retain their respective shape and structure. In some embodiments, the cover may be formed of less rigid materials, such as a rubber. In some embodiments, the outer shell, the inner shell, and/or the removable container may be formed of thermos-insulating materials. The removable container and/or the inner shell may also be formed of condensation resistant materials. The materials for forming the removable container may also be dishwasher safe. The inner shell and the outer shell may be formed as a unitary piece by molding, 3D printing, or any suitable manufacturing method. The inner shell and the outer shell may be formed as separate pieces and subsequently coupled together by welding, gluing, stapling, riveting, fastening, or any suitable coupling method.

FIG. 1 illustrates an exemplary drinking vessel 100 having an air moving device for delivering air to a user. The drinking vessel 100 may include an inner shell 105 and an outer shell 110. The inner shell 105 and the outer shell 110 may be coupled with each other at the top edge 112 of the inner shell 105 and the top edge 114 of the outer shell 110. The inner shell 105 and the outer shell 110 may together at least partially define an air flow passage 116. The inner shell 105 may include a base 118 and a side 120 extending at least partially in an upward direction from an outer edge of the base 118. The outer shell 110 may include a base 122, a side 124 extending at least partially in an upward direction from an outer edge of the base 122, and an annular protrusion 126 extending at least partially in a downward direction from the outer edge of the base 122. The base 122 of the outer shell 110 may define one or more air inlets 128. The side 124 of the outer shell 110 may also define one or more air inlets 130 adjacent or near the base 122 of the outer shell 110. The annular protrusion 126 of the outer shell 110 may further define one or more air inlets 132 adjacent or near the base 122 of the outer shell 110. The side 124 of the outer shell 110 may further define an air outlet 134. The air flow passage 116 is in communication with the air inlets 128, 130, 132 and the air outlet 134.

In this embodiment, the annular protrusion 126 of the outer shell 110 may include a bottom edge 140 that may support the drinking vessel 100 on a surface. The bottom edge 140 may include a non-linear profile. When the drinking vessel 100 may be rested on a surface, portions 142 of the bottom edge 140 may be elevated from the surface. The elevated portions 142 of the bottom edge 140 and the surface upon which the drinking vessel 100 may be rested may define one or more openings. Air may flow through the openings toward the air inlets 128 disposed at the base 122 of the outer shell 110 into the air flow passage 116.

In this embodiment, the inner shell 105 may be disposed off-center inside the outer shell 110. At least a portion of the side 120 of the inner shell 105 may be tapered. Specifically, a portion 150 of the side 120 of the inner shell 105 facing the air outlet 134 may be tapered inwardly such that at least the tapered portion 150 and the side 124 of the outer shell 110 may define a funnel with the smaller end of the funnel disposed proximate the air outlet 134. In this embodiment, the tapered portion 150 may extend from the top edge 112 of the inner shell 105 only part way toward the base 118 of the inner shell 105. In some embodiments, the tapered portion 150 may extend from near the top edge 112 of the inner shell 105 all the way toward the base 118 of the inner shell 105. The portion 152 of the side 120 of the inner shell 105 opposite the air outlet 134 may not be tapered so as to maximize an inner compartment 154 defined by the inner shell 105 for holding a removable container and/or a liquid for consumption by the user.

The drinking vessel 100 may further include an air moving device 160. The air moving device 160 may be configured to move air from the air inlets 128, 130, 132 disposed at the base 122, the side 124, or the annular protrusion 126 of the outer shell 110. The air moving device 160 may also move air through the openings defined by the elevated portions 142 of the bottom edge 140 and the surface upon which the drinking vessel 100 may be rested. The air moving device 160 may include a centrifugal fan. The centrifugal fan may be partially disposed between the side 124 of the outer shell 110 and the side 120 of the inner shell 105.

The drinking vessel 100 may also include a power source 164 operably coupled with the air moving device 160. The drinking vessel 100 may further include an actuation device 168 operably coupled with the air moving device 160 and the power source 164. In this embodiment, the actuation device 168 may include a button or touch switch that the user may press or touch. Other actuation devices described above may be implemented. When the user may touch or press the actuation device 168, the air moving device 160 may be activated with the power source 164 and may move air from the air inlets 128, 130, 132 toward the air outlet 134 through the air flow passage 116.

The drinking vessel 100 may also include a temperature adjusting element 170 for changing a temperature of air flowed through the air flow passage 116. The temperature adjusting element 170 may be operably coupled with the power source 164. Any one or more of the embodiments of the temperature adjusting elements discussed above may be implemented. The air moving device 160 may be configured to move air across or through the temperature adjusting element 170, which may cool or warm the air. This way, a temperature of air passing through the air outlets 134 may be different from a temperature of air passing through the air inlets 128, 130, 132.

Figure 2:
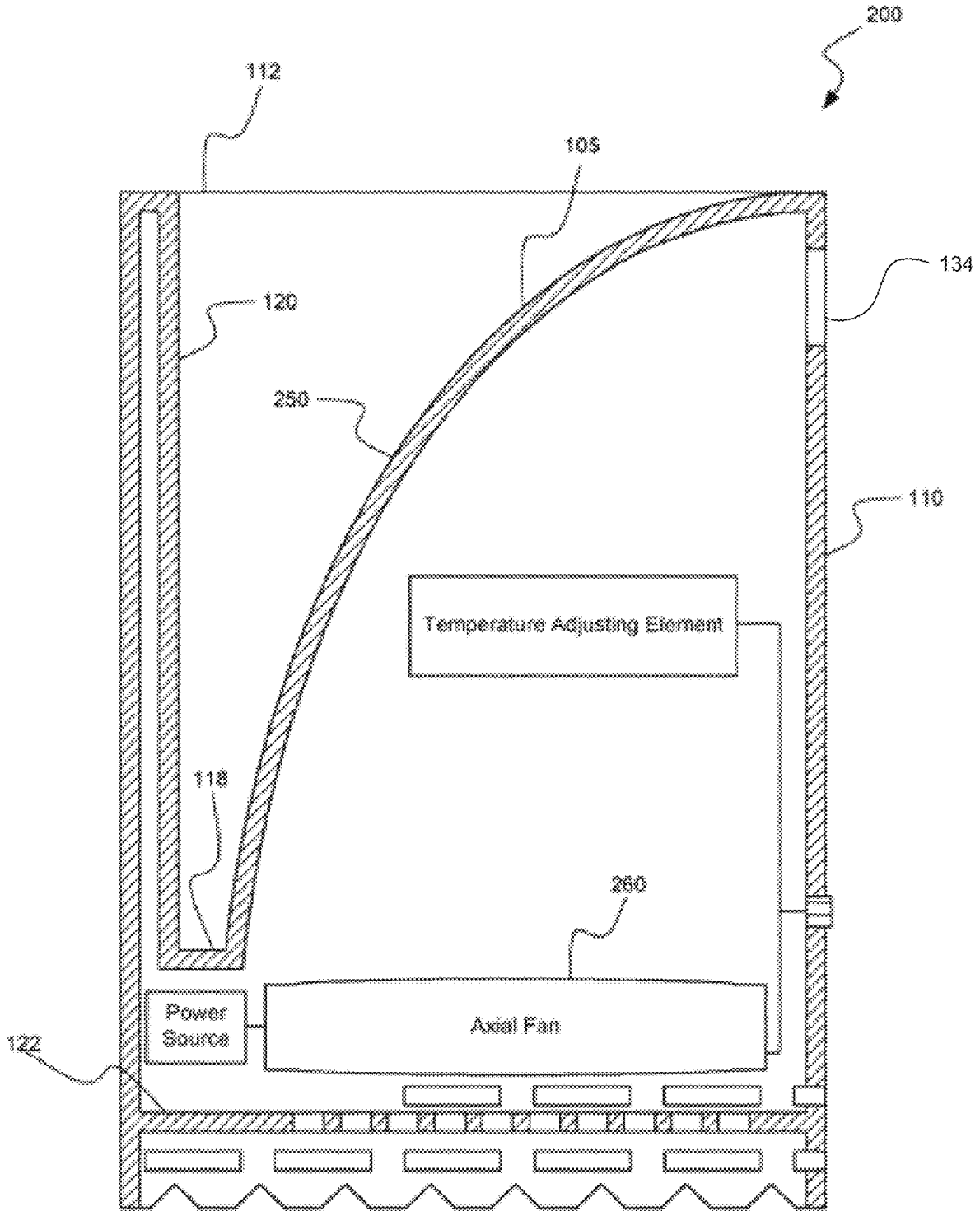
FIG. 2 illustrates another exemplary drinking vessel or drinking vessel-like device according to embodiments of the present disclosure.

FIG. 2 illustrates another exemplary drinking vessel 200 having an air moving device for delivering air to a user. The drinking vessel 200 may include components similar to those of the drinking vessel 100 described above with reference to FIG. 1. The embodiment shown in FIG. 2 may differ from the embodiment shown in FIG. 1 at least in that an axial fan 260 may be utilized as the air moving device. Additionally, to facilitate the air flow generated by the axial fan 260, the side 120 of the inner shell 105 may include a tapered portion 250 that may extend from near the top edge 112 of the inner shell 105 almost all the way toward the base 118 of the inner shell 105. The axial fan 260 may be disposed between the base 122 of the outer shell 110 and the base 118 of the inner shell 105.

Figure 3:
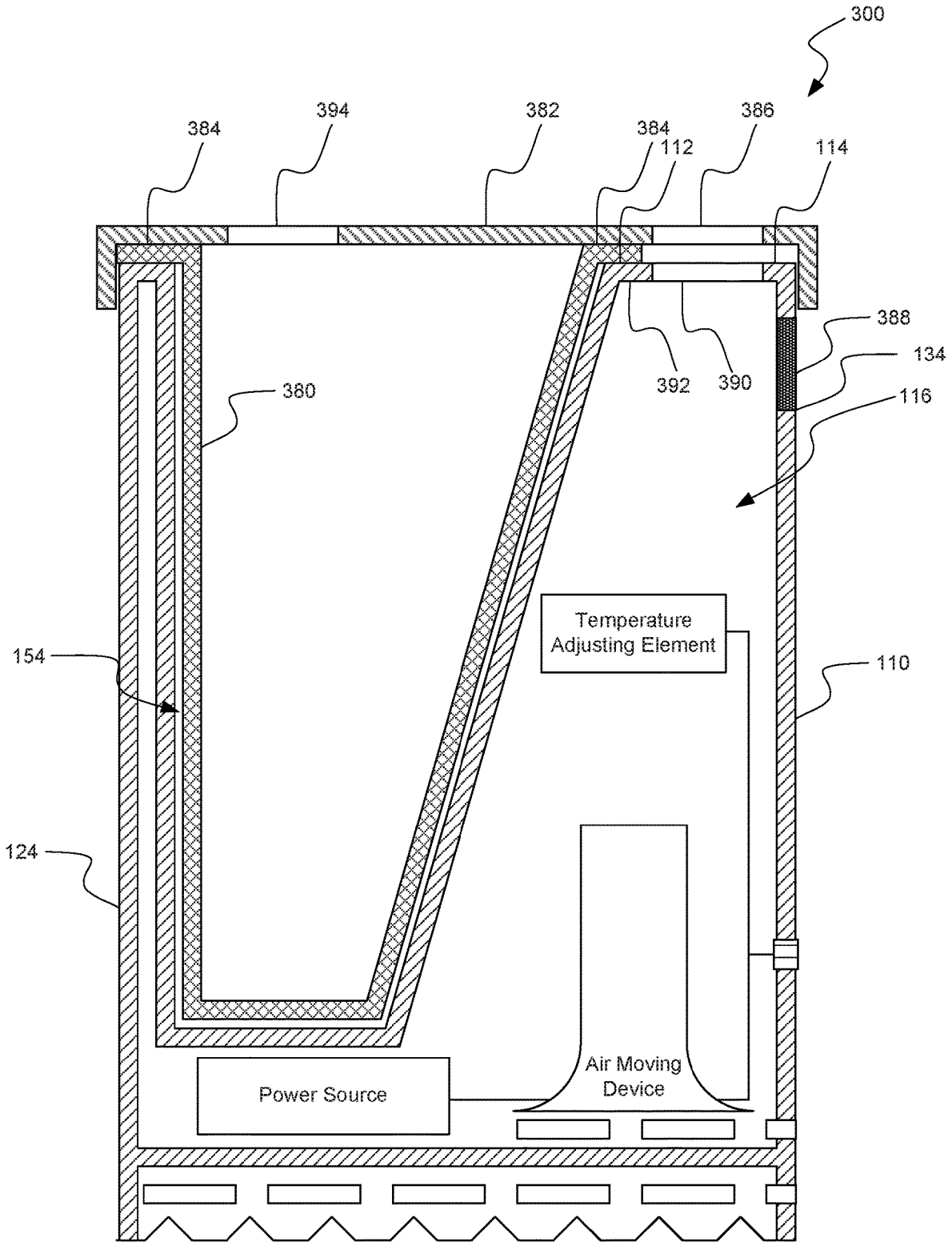
FIG. 3 illustrates another exemplary drinking vessel or drinking vessel-like device according to embodiments of the present disclosure.

FIG. 3 illustrates another exemplary drinking vessel 300 having an air moving device for delivering air to a user. The drinking vessel 300 may include components similar to those of the drinking vessels 100, 200 described above with reference to FIGS. 1 and 2. The drinking vessel 300 may further include a removable container 380 and a cover 382.

The removable container 380 may be disposed inside the inner compartment 154 defined by the inner shell 105. The removable container 380 may include a flange 384. The flange 384 may contact the top edge 112 of the inner shell 105 when the removable container 380 may be placed inside the inner compartment 154 of the inner shell 105. The removable container 380 may be configured to hold a liquid for consumption by the user.

As discussed above, the inner shell 105 may be formed without any apertures at its base 118 or side 120. Accordingly, the inner compartment 154 defined by the side 120 and the base 118 of the inner shell 105 may be separated from the air flow passage 116. When the user may place the cover 382 onto the drinking vessel 300, the cover 382 and the inner shell 105 may together isolate the inner compartment 154 from the air flow passage 116. Further, given the contact or seal that may be formed between the cover 382 and the flange 384 of the removable container 380, the cover 382 may also prevent any liquid spillage from the removable container 380 into the air flow passage 116.

In this embodiment, the cover 382 may also define an air outlet 386. The side 124 of the outer shell 110 may not be formed with an air outlet, or the air outlet 134 defined by the outer shell 110 may be closed by a closing mechanism 388 as discussed above. An air outlet 390 may be defined by a coupling portion 392 through which the top edge 112 of the inner shell 105 and the top edge 114 of the outer shell 110 may be coupled with each other. The air outlet 390 defined by the coupling portion 392 may be aligned with the air outlet 386 defined by the cover 382 to facilitate air flowing toward the user. The cover 382 may further define a drinking portal 394. The user may access the liquid held inside the removable container 380 through the drinking portal 394.

Figure 4:
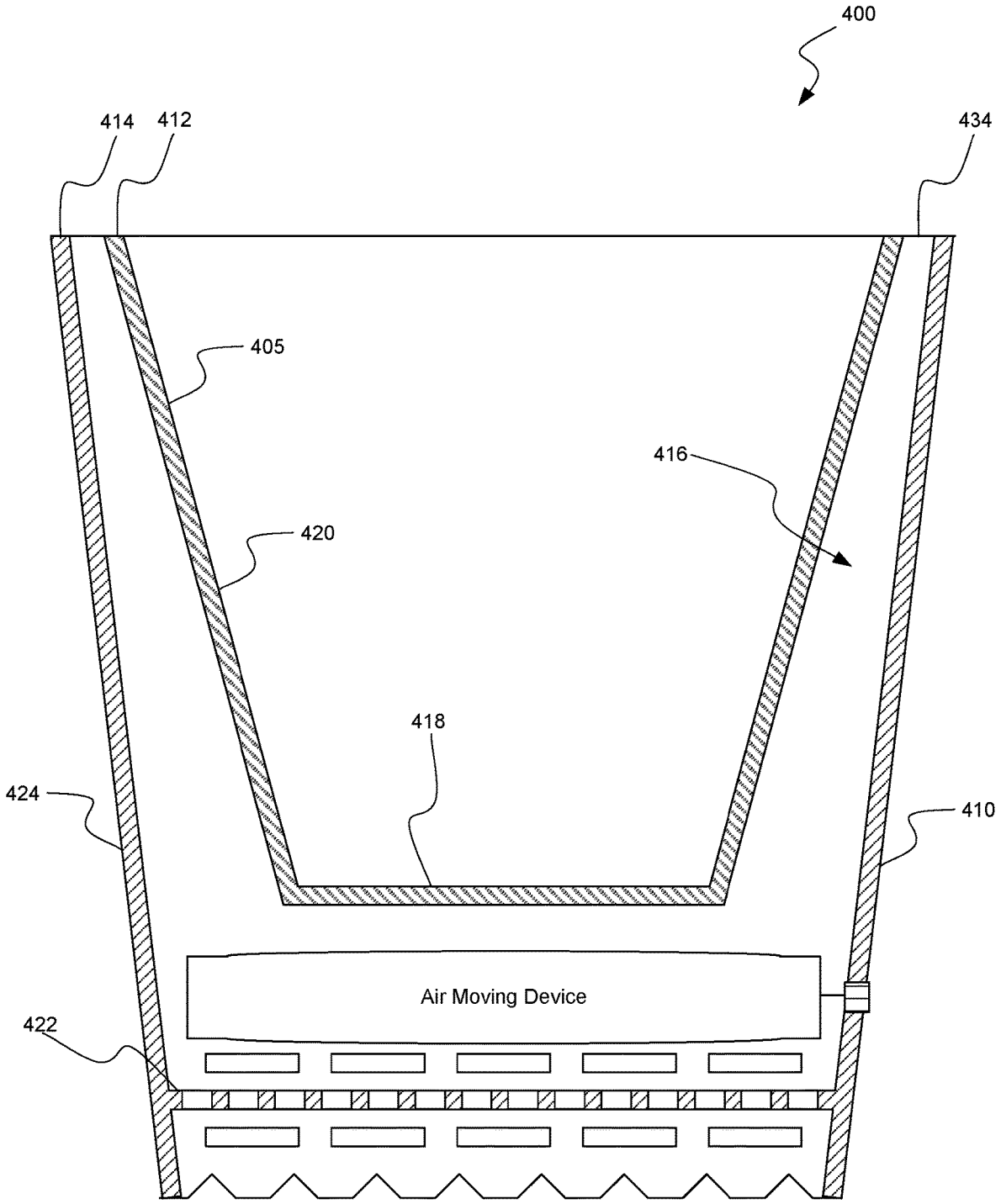
FIG. 4 illustrates another exemplary drinking vessel or drinking vessel-like device according to embodiments of the present disclosure.

FIG. 4 illustrates another exemplary drinking vessel 400 having an air moving device for delivering air to a user. The drinking vessel 400 may include components similar to those of the drinking vessels 100, 200, 300 described above with reference to FIGS. 1, 2, and 3. In this embodiment, an inner shell 405 may be placed at or near a center of an outer shell 410. An air flow passage 416 may be defined by the space between a side 420 of the inner shell 405 and a side 424 of the outer shell 410. In some embodiments, the side 420 of the inner shell 405 and the side 424 of the outer shell 410 may be parallel to each other and the space defined therebetween may define an annular prism. In some embodiments, the side 420 of the inner shell 405 and the side 424 of the outer shell 410 may form an angle with respect to each other to guide the air flow in a converging or diverging manner. The top edge 412 of the inner shell 405 and the top edge 414 of the outer shell 410 may define an annular gap there-between. The annular gap may constitute an air outlet 434 for the drinking vessel 400.

The air flow passage 416 and the air outlet 434 may guide air to flow in a divergent manner. Specifically, the side 424 of the outer shell 410 may be tapered outwardly from a base 422 of the outer shell 410. A side 420 of the inner shell 405 may also be tapered outwardly from a base 418 of the inner shell 405. With such configuration, air flowing out of the air outlet 434 may diverge such that the air may be delivered to an area greater than an area defined by the air outlet 434 or an area defined by the top edge 414 of the outer shell 410. Accordingly, the user may use the drinking vessel 400 to cool or warm up a body area without moving the drinking vessel 400 around or excessively.

Figure 5A:
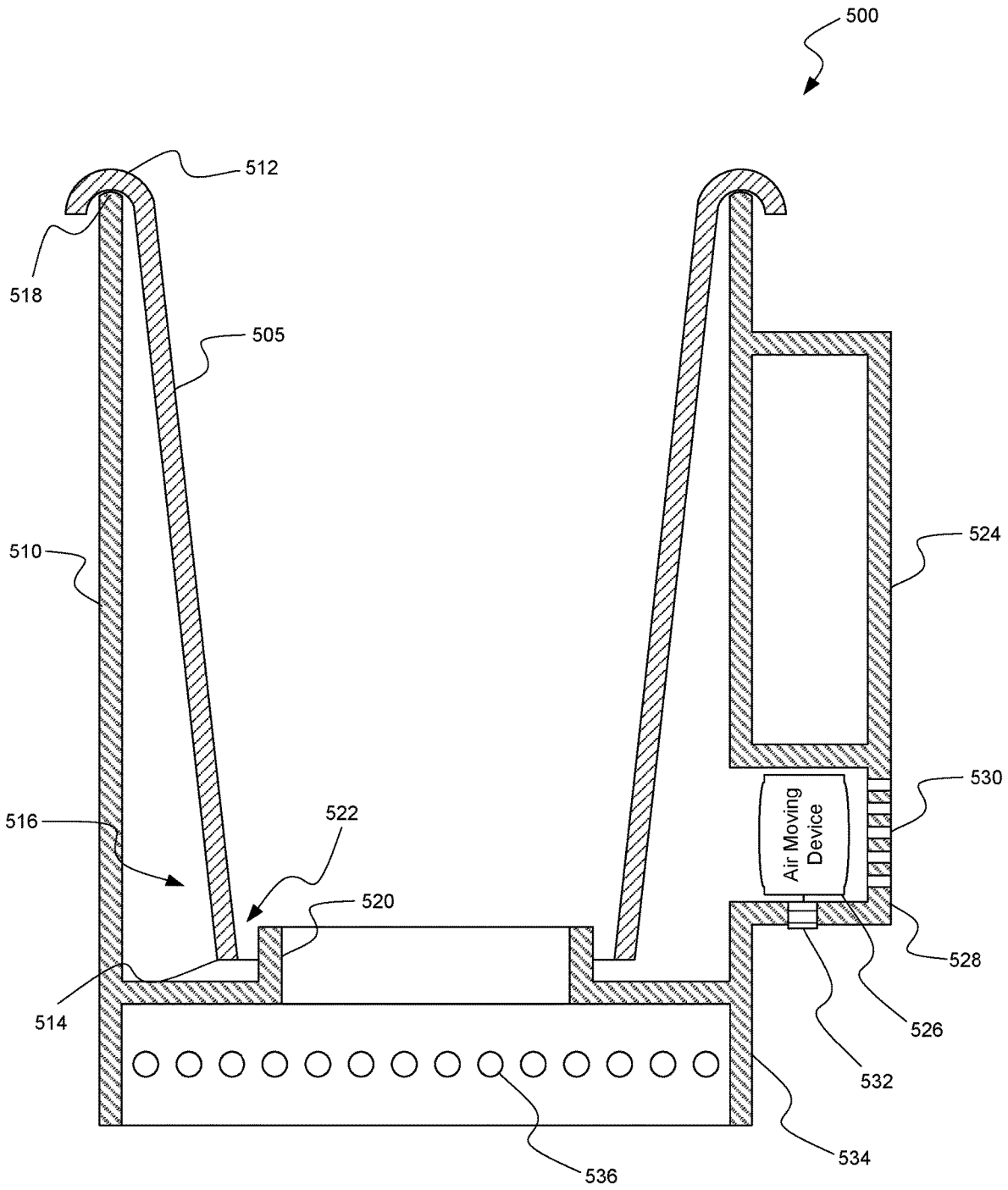
FIGS. 5A and 5B illustrate another exemplary drinking vessel or drinking vessel-like device according to embodiments of the present disclosure.
Figure 5B:
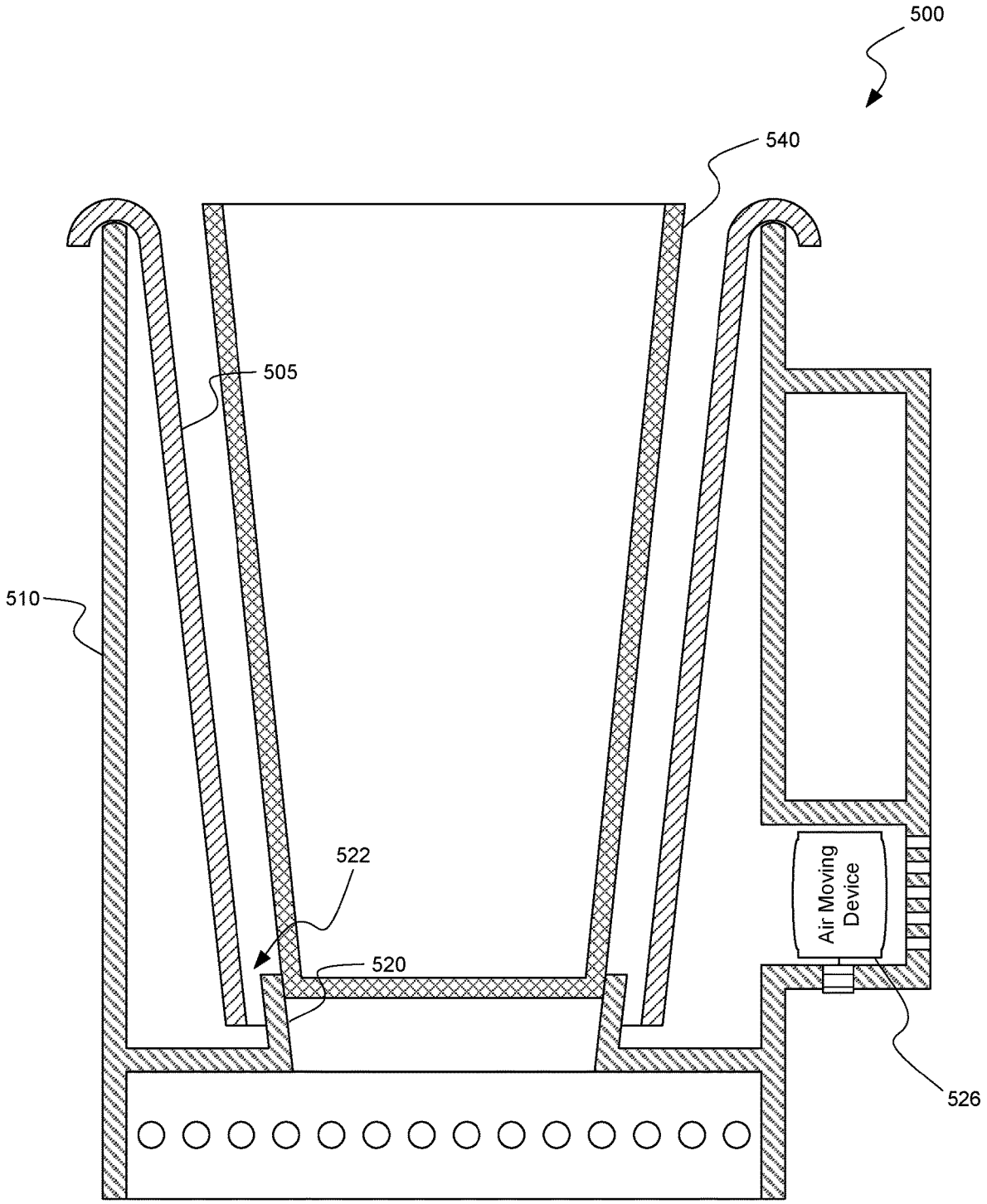

FIGS. 5A and 5B illustrate another exemplary drinking vessel or drinking vessel-like device 500 for delivering air to a user. The device 500 may include an inner shell 505 and an outer shell 510. The inner shell 505 and the outer shell 510 may together at least partially define an air flow passage 516. The inner shell 505 may include a top rim 512 that may define a top opening and a bottom rim 514 that may define a bottom opening which may have substantially a circular shape. The outer shell 510 may include a top rim 518 coupled with the top rim 512 of the inner shell 505. The outer shell 510 may further include a base that may include an annular lip 520. The annular lip 520 may define a cylindrical opening that may be concentrically aligned with the bottom opening defined by the bottom rim 514 of the inner shell 505. The annular lip 520 may be positioned radially inward from the bottom rim 514 of the inner shell 505 and may extend upward into the bottom opening defined by the bottom rim 514 of the inner shell 505. As such, the annular lip 520 may overlap with a lower portion of the inner shell 505. The overlapping portions of the annular lip 520 and the inner shell 505 may define an annular air outlet 522 and may guide air to move upward towards the top opening defined by the top rim 512 of the inner shell 505.

The outer shell 510 may further include a handle 524. The handle may be configured to house an air moving device 526 and configured to allow air to be drawn by the air moving device 526 into the air flow passage 516 defined by the inner shell 505 and the outer shell 510. In some embodiments, a temperature adjusting element may also be housed inside the handle 524 for adjusting the temperature that may be moved or delivered. Power source, control circuits, and other components for operation of the device 500 may also be housed inside the handle 524. Specifically, the handle 524 may define a housing 528 in fluid communication with the air flow passage 516 and configured to house the air moving device 526, the temperature adjusting element, and various other components. In some embodiments, the housing 528 may be configured near a lower portion of the handle 524. In some embodiments, the housing 528 may be configured near a middle portion, an upper portion, or any other suitable portion of the handle 524. The handle 524 may further define one or more apertures 530 configured at the housing 528. When the air moving device 526 may be activated by an actuation device 532, air may be drawn from the apertures 530 into the housing 528, then moved into the air flow passage 516, and then moved through the annular air outlet 522 toward the top opening defined by the top rim 512 of the inner shell 505.

As air may be moved toward the top opening of the inner shell 505, a lower pressure zone may be created inside the inner shell 505. The lower pressure zone may cause more air to be drawn from the cylindrical opening defined by the annular lip 520 of the outer shell 510 from the bottom of the outer shell 510. In this embodiment, the outer shell 510 may further include a downward extending annular protrusion 534, which may be formed with one or more apertures 536. When the device 500 may be rest on a surface, more air may still be drawn through the apertures 536 towards the cylindrical opening defined by the annular lip 520 of the outer shell 510. As more air may be drawn towards the top opening of the inner shell 505 from the bottom of the device 500, the air moving device may be configured with a small motor, and may operate more efficiently with less noise.

As shown in FIG. 5A, the device 500 may appear as a drinking vessel but may operate to move air to cool or warm up an user of the device 500. As shown in FIG. 5B, the device 500 may be configured to host a removable container 540 for holding a beverage or any liquid therein. The removable container 540 may be a glass, a cup, a bottle, or any other liquid container a user may desire to place inside the device 500. In some embodiments, the annular lip 520 of the outer shell 510 may be tapered outwardly upward for receiving a bottom portion of the removable container 540. The removable container 540 may be supported by the annular lip 520 such that a gap or space may be formed between the removable container 540 and the inner shell 505. This way, warm or cool air may still be moved by the air moving device 526 through the annular outlet 522 defined by the overlapping portion of the annular lip 520 and the lower portion of the inner shell 505, into the space between the removable container 540 and the inner shell 505, and then towards the top opening of the inner shell 505 to provide a warming or cooling effect for the user.

Although FIGS. 5A and 5B illustrate embodiments where at least the inner shell 505 and/or the removable container 540 may be tapered outwardly upward such that the air flow may be guided towards the user in a divergent manner, the inner shell 505 and/or the removable container 540 may be tapered differently in other embodiments such that the air flow may be guided towards the user in a convergent manner. For example, at least the inner shell 505 may be tapered inwardly upward. In some embodiments, the side of the removable container 540 may also be tapered inwardly upward to direct the air flow towards the user in a convergent manner. In some embodiments, the device 500 may further include a cover. The cover may be configured to be placed over the opening defined by the top edge of the removable container 540. In some embodiments, the cover may be configured to be placed over the top rim 512 of the inner shell 505 and/or the top rim 518 of the outer shell 510. In these embodiments, the cover may include one or more air outlets to allow air flow towards the user.

Figure 6A:
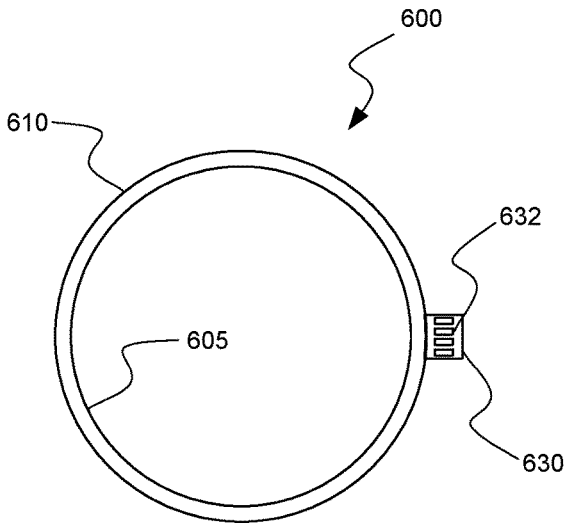
FIGS. 6A and 6B illustrate an exemplary air moving system that may be used with any drinking vessel according to embodiments of the present disclosure.
Figure 6B:
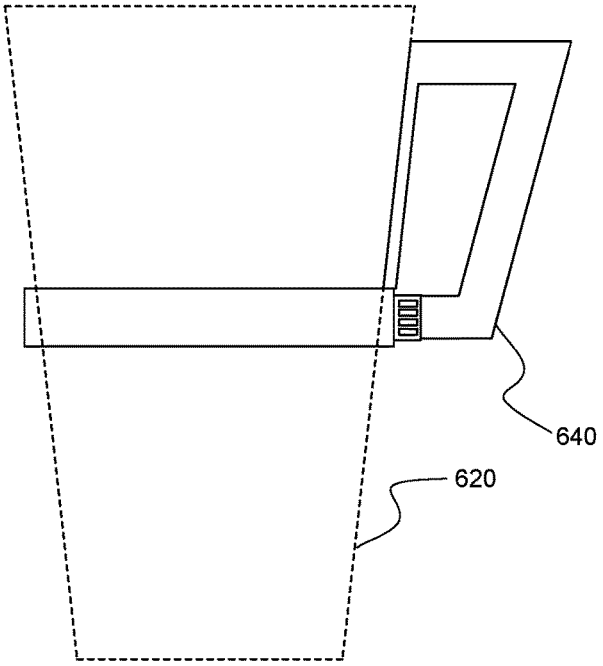

FIGS. 6A and 6B illustrate an embodiment of an air moving system 600 that may be used with any drinking vessel or drinking device. The air moving system 600 may be configured in a manner similar to how the device 500 may be configured, except that the inner shell 605 and the outer shell 610 may be configured with less height dimensions as compared to the height dimensions of the inner shell 505 and the outer shell 510 of the device 500. In some embodiments, the inner shell 605 and/or the outer shell 610 may be configured with height dimensions that may about 50% or less, about 40% or less, about 30% or less, about 20% or less, about 10% or less, about 5% or less of the height dimensions of the inner shell 505 and/or the outer shell 510 of the air moving system 500. As such, the air moving system 600 may resemble a ring member that may be placed around a lower portion, a middle portion, or an upper portion of any drinking vessel 620 a user may desire as shown in FIG. 6B.

The air moving system 600 may include a side compartment or housing 630 for housing therein an air moving device, a temperature adjusting element, or any components as discussed above with reference to device 500. The air moving device may be configured to move air through one or more apertures or air inlets 632 configured at the side compartment 530, into an air flow passage defined by the inner and outer shell 605, 610, and then through an annular air outlet near one side, such as a bottom of the air moving system 600 towards the other side, such as a top of the air moving system 600. When the air moving system 600 may be placed around any drinking vessel 620 the user may desire, a gap or space may be formed between the inner shell and the drinking vessel 620, similar to the gap formed between the inner shell 505 and the removable container 540 as shown in FIG. 5B. By activating the air moving system 600 through an actuation device (not shown), air may be moved or delivered by the air moving device from the apertures 632 into the air flow passage, out through the annular air outlet, and then upward along the side surface of the drinking vessel 620 towards the user to provide a warming or cooling effect. In some embodiments, the air moving system 600 may be configured with a handle 640 as shown in FIG. 6B for ease of handling.

Figure 7A:
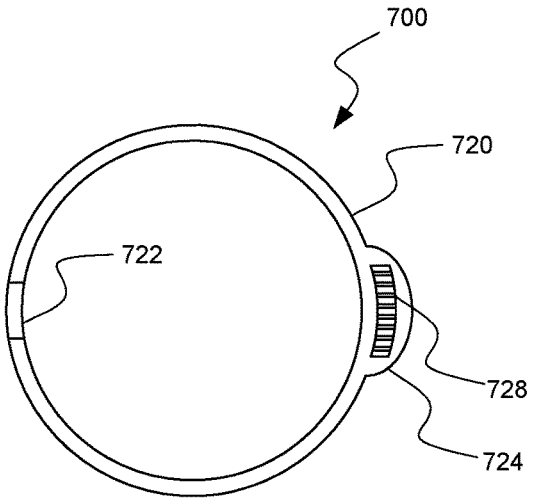
FIGS. 7A and 7B illustrate another exemplary air moving system that may be used with any drinking vessel according to embodiments of the present disclosure.
Figure 7B:
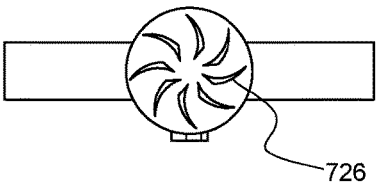

FIGS. 7A and 7B illustrate another embodiment of an air moving system 700 that may be used with any drinking vessel or drinking device. Similar to the air moving system 600, the air moving system 700 may resemble or be shaped like a ring that may be placed around any drinking device, such as a cup, glass, water bottle, etc., that a user may desire to use. Different from the air moving system 600, the air moving system 700 may include a ring member 720 that may be opened and closed through a securing mechanism 722 for easy placement of the air moving system 700 around a drinking device. The ring member 720 may be made of relatively flexible material that may be folded for storage purposes. The ring member 720 may be configured with a housing 724 within which an air moving device, a temperature adjustment element, and other components for the operation of the air moving system 700 may be housed. Upon activating an actuation device, the air moving device inside the housing 724 may draw air through one or more apertures or air inlets 726 formed at the side of the ring member 720. The ring member 720 may be configured with one or more apertures or air outlets 728 formed at the top of the ring member 720 through which the air moving device may deliver warm or cool air towards the user.

Figure 8:
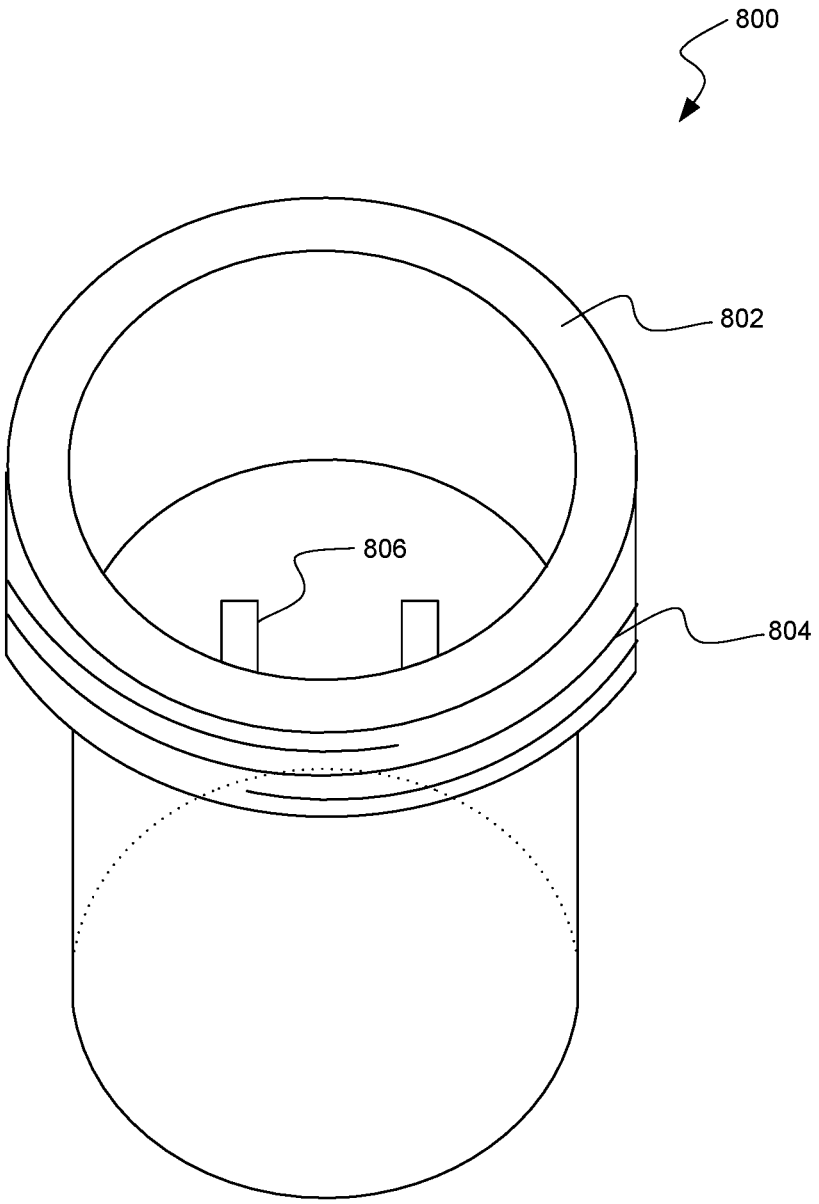
FIG. 8 illustrates an exemplary detachable holder that may be used with any drinking vessel or drinking vessel-like device according to embodiments of the present disclosure.

FIG. 8 illustrates an embodiment of a detachable holder 800 for a drinking vessel or drinking vessel-like device, such as any of the drinking vessel or drinking vessel-like device discussed above. The detachable holder 800 may be made with a relatively rigid material to retain its shape and to provide support for a drinking vessel to which the holder 800 may be attached. The detachable holder 800 may be sized for fitting into standard or common cup holders, such as cup holders in cars, carts, boats, chairs, and so on. As such, when any of the drinking vessel or drinking vessel-like devices may be attached to the detachable holder 800, the drinking vessel or drinking vessel-like devices may be properly fitted into any standard or common cup holders. In some embodiments, the detachable holder 800 may include a bottom portion that may include a relatively heavier material contained therein so as to increase the stability of the drinking vessel or drinking vessel-like devices when attached to the detachable holder 800. In some embodiments, the detachable holder 800 may further include friction elements, such as a rubber bottom, for added stability.

In some embodiments, the detachable holder 800 may include a widened top portion so as to form a flat surface or platform 802 for supporting the drinking vessel attached thereto. In some embodiments, the detachable holder 800 may include threading 804 formed on an outside rim of the detachable holder 800 configured to engage mating threading formed on an inside rim of the drinking device. In some embodiments, the detachable holder 800 may not include threading and may be fitted into a bottom opening of the drinking vessel and attached thereto through a latch device, or via interference fit, snap fit, or any suitable engagement mechanism. In some embodiments, the detachable holder 800 may include a battery unit contained therein and may be configured with ports 806 for charging the drinking vessel attached thereto with the power from the battery unit. The battery unit with its weight may also increase the stability of the detachable holder 800 when coupled with the drinking vessel.

Specific details are given in the preceding description to provide a thorough understanding of the embodiments. However, it will be understood by one of ordinary skill in the art that the embodiments may be practiced with or without these specific details. For example, power sources, actuation devices, circuits, fans, temperature adjustment elements, and other elements in the embodiments may be shown as components in block diagram form in order not to obscure the embodiments in unnecessary detail.

Various embodiments of the invention have now been described in detail for the purposes of clarity and understanding. However, it will be appreciated that certain changes and modifications may be practiced within the scope of the appended claims.

What is claimed is:

1. A portable drink container comprising:

an outer shell, the outer shell including:

a plurality of openings near a base of the outer shell, the plurality of openings forming air inlets and the plurality of openings being oriented perpendicular to an axis of the portable drink container;

an inner shell coupled with the outer shell, wherein:

the inner shell and the outer shell form an air outlet defined by a coupling portion through which a top edge of the inner shell and a top edge of the outer shell are coupled with each other, the air outlet having an axis that is oriented parallel to the axis of the portable drink container;

the inner shell and the outer shell define an air flow passage; and the air flow passage is in communication with the air inlets and the air outlet;

an air moving device configured to move air from the air inlets, through the air flow passage, to the air outlet, the air moving device having an air intake port positioned adjacent the air inlets and having an air outflow port that is oriented toward the air outlet;

a power source operably coupled with the air moving device;

an actuation device operably coupled with the air moving device and the power source for selectively activating the air moving device with the power source; and a removable cover that is coupleable with a top end of the portable drink container, the removable cover including an aperture that defines an air outlet, the air outlet of the removable cover being alignable with the air outlet defined by the inner shell and the outer shell when the removable cover is coupled with the top end of the portable drink container;

wherein the air inlets, the air flow passage, and the air outlet are arranged so that the air flows through the air flow passage and through the air outlet.

2. The portable drink container of claim 1, wherein an outer edge of the removable cover includes a lip that is positionable over an exterior surface of an upper end of the outer shell.

3. The portable drink container of claim 1, further comprising:

a temperature adjusting element for changing a temperature of air; and wherein:

the temperature adjusting element is operably coupled with the power source; and the air moving device is further configured to move air across or through the temperature adjusting element such that a first temperature of air passing through the air inlets is different from a second temperature of air passing through the air outlet.

4. The portable drink container of claim 1, further comprising:

a removable container, wherein:

the inner shell comprises a top edge defining an opening into the inner shell;

the removable container is configured to be disposed in the opening;

the removable container comprises a flange;

the flange is configured to contact the top edge of the inner shell when the removable container is disposed in the opening; and the removable cover is positionable over the removable container so that the removable container is entirely covered by the removable cover.

5. A portable drink container comprising:

an outer shell, the outer shell including an air inlet near a base of the outer shell; and an inner shell coupled with the outer shell, the inner shell and the outer shell defining an air outlet at an upper end where the inner shell couples with the outer shell, the inner shell and the outer shell defining an air flow passage between the air inlet and the air outlet;

an air moving device configured to move air from the air inlet, through the air flow passage, to the air outlet, the air moving device having an air intake port positioned adjacent the air inlet and having an air outflow port oriented toward the air outlet; and a removable cover that is coupleable with a top end of the portable drink container, the removable cover including an aperture that defines an air outlet, the air outlet of the removable cover being alienable with the air outlet defined by the inner shell and the outer shell when the removable cover is coupled with the top end of the portable drink container.

6. The portable drink container of claim 5, wherein:

the inner shell defines at least an inner compartment; and the removable cover is configured to isolate the inner compartment from the air flow passage.

7. The portable drink container of claim 5, wherein the air outlet defined by the inner shell and the outer shell is closeable.

8. The portable drink container of claim 1, wherein each opening of the plurality of openings is an elongated slot, and wherein the elongated slots are arranged concentrically about the base and are oriented circumferentially about an exterior cylindrical surface of the base.

9. The portable drink container of claim 1, wherein the plurality of openings are arranged along only a portion of a circumference of the base so that the plurality of openings face a user.

10. The portable drink container of claim 1, wherein the inner shell and the outer shell taper toward the upper end so that the air is funneled toward the air outlet.

11. The portable drink container of claim 10, wherein the air moving device is a centrifugal fan that is positioned inside the air flow passage so that a base of the centrifugal fan is between a non-tapered portion of the side of the inner shell and a side of the outer shell.

12. The portable drink container of claim 4, wherein the removable cover is positionable over the removable container to form a seal between the removable cover and the flange that prevents liquid spillage from the removable container into the air flow passage.

13. The portable drink container of claim 4, wherein the removable cover also includes an aperture that defines a drinking portal through which liquid contained in the removable container is accessible.

14. The portable drink container of claim 1, wherein the outer shell includes an air outlet that is positioned on a side of the outer shell, the air outlet of the outer shell being separate from the air outlet defined by the inner shell and the outer shell.

15. The portable drink container of claim 14, further comprising a closing mechanism that is configured to close the air outlet of the outer shell.

16. A portable drink container comprising:

an outer shell, the outer shell including:

a plurality of openings near a base of the outer shell, the plurality of openings forming air inlets and the plurality of openings being oriented perpendicular to an axis of the portable drink container;

an inner shell coupled with the outer shell, wherein:

the inner shell and the outer shell form an air outlet defined by a coupling portion through which a top edge of the inner shell and a top edge of the outer shell are coupled with each other, the air outlet having an axis that is oriented parallel to the axis of the portable drink container;

the inner shell and the outer shell define an air flow passage; and the air flow passage is in communication with the air inlets and the air outlet;

an air moving device configured to move air from the air inlets, through the air flow passage, to the air outlet, the air moving device having an air intake port positioned adjacent the air inlets and having an air outflow port that is oriented toward the air outlet;

a power source operably coupled with the air moving device;

an actuation device operably coupled with the air moving device and the power source for selectively activating the air moving device with the power source; and a closing mechanism;

wherein the air inlets, the air flow passage, and the air outlet are arranged so that the air flows through the air flow passage and through the air outlet;

wherein the outer shell includes an air outlet that is positioned on a side of the outer shell, the air outlet of the outer shell being separate from the air outlet defined by the inner shell and the outer shell; and wherein the closing mechanism is configured to close the air outlet of the outer shell.

17. The portable drink container of claim 16, further comprising a removable cover that is coupleable with a top end of the portable drink container, the removable cover including an aperture that defines an air outlet, the air outlet of the removable cover being alignable with the air outlet defined by the inner shell and the outer shell when the removable cover is coupled with the top end of the portable drink container.

18. The portable drink container of claim 17, further comprising a removable container that is positionable within an interior of the portable drink container, wherein the removable cover is positionable over the removable container so that the removable container is entirely covered by the removable cover.

* * * * *